US007438579B1

(12) United States Patent
Pellen

(10) Patent No.: US 7,438,579 B1
(45) Date of Patent: Oct. 21, 2008

(54) ANTI-DECOUPLING DEVICE FOR A SPIN COUPLING

(75) Inventor: Alain T. Pellen, Boca Raton, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/778,749

(22) Filed: Jul. 17, 2007

(51) Int. Cl.
*H01R 13/62* (2006.01)

(52) U.S. Cl. ..... 439/312

(58) Field of Classification Search ..... 439/312–319, 439/321, 320, 470, 446, 488, 322, 323, 471–473, 439/307, 310, 311, 318, 180, 352, 350
See application file for complete search history.

(56) References Cited

U.S. PATENT DOCUMENTS 4,441,775 A * 4/1984 Walters ..... 439/312
4,534,607 A * 8/1985 Tomsa ..... 439/312
4,808,123 A * 2/1989 Dee et al. ..... 439/470
4,834,667 A 5/1989 Fowler et al.
4,863,396 A * 9/1989 Johnson ..... 439/470
5,590,228 A 12/1996 Gibola et al.
6,086,400 A 7/2000 Fowler
6,368,134 B2 4/2002 Richter
6,527,575 B2 3/2003 Scholler
6,966,788 B1 11/2005 Ruhl, Jr.

* cited by examiner

*Primary Examiner*—Edwin A. León
(74) *Attorney, Agent, or Firm*—DeMont & Breyer LLC

(57) ABSTRACT

An anti-decoupling device for use in preventing undesired rotation of a spin coupling of, for example, a two-part electrical connector, is disclosed. The anti-decoupling device can form part of a new connector, or can be used to retrofit existing connectors without having to modify the connector. In some embodiments, the anti-decoupling device comprises a base and two prongs that extend in a generally axial direction relative to the base. Blades that depend from the prongs extend into channels within the knurled side-edge of the spin coupling. The blades prevent inadvertent rotation of the spin coupling.

20 Claims, 4 Drawing Sheets

ANTI-DECOUPLING DEVICE FOR A SPIN COUPLING

FIELD OF THE INVENTION

The present invention relates to connectors, and, more particularly, to a device that prevents a spin coupling from loosening.

BACKGROUND OF THE INVENTION

It is common practice to use a two-part connector to join electrical conductors. In such connectors, a first group of electrical conductors terminate in one of the connector "halves" and a second group of electrical conductors terminate in the other of the connector halves. To establish electrical connection between the two groups of electrical conductors, the two connector halves are joined.

The two halves of the connector are typically held together by a nut, typically referred to as a "spin coupling," a "coupling nut," or a "locking ring." The spin coupling is usually permanently attached to one of the connector halves at the time of initial assembly. In some embodiments, the spin coupling is internally threaded and is rotated to engage mating threads on the other connector half.

The spin coupling is the primary means of maintaining the integrity of the mechanical and electrical interfaces of the two-part connector. As a consequence, after the two connector halves are joined, it is very important that the spin coupling does not rotate in such a way as to loosen. Inadvertent rotation can result, for example, from shock, vibration, G-loading, etc.

Many anti-decoupling mechanisms have been proposed to prevent inadvertent rotation of a connector spin coupling. But few if any of these mechanisms can be used to retrofit standard connectors. Rather, in most cases, the mechanisms are an integral part of what is effectively a new connector design. In the few cases that the mechanisms can be used to retrofit a standard connector, the retrofit requires modifying the standard connector, such as by machining it, to add notches, holes, and the like.

The ability to retrofit a standard connector with an anti-decoupling device without modifying the connector would be very beneficial.

SUMMARY OF THE INVENTION

The present invention provides a way to prevent a spin coupling from loosening without some of the costs and disadvantages of the prior art.

In accordance with the illustrative embodiment of the present invention, an anti-decoupling device is used to prevent undesired rotation of a spin coupling of, for example, a two-part electrical connector. Among other benefits of the anti-decoupling device disclosed herein, it can be used to retrofit existing connectors without having to modify the connector. Furthermore, in some embodiments, the anti-decoupling device is able to retrofit an in-field connector without having to disassemble the connector.

In accordance with the illustrative embodiment, the anti-decoupling device comprises a base and two prongs that extend in a generally axial (as opposed to radial) direction relative to the base.

In use, the base of the anti-decoupling device couples to a fitting (e.g., a hex nut, etc.) that attaches one half of the electrical connector to, for example, a bulkhead, an electrical box, etc. The base has a large, centrally-located opening (i.e., like a washer). In use, one of the connector portions is received by this opening.

The prongs of the anti-decoupling device are diametrically opposed to one another on the base. The prongs extend sufficiently far in the axial direction so that the free end of each prong aligns with the spin coupling (when the spin coupling is in a locking positioning for joining the two connector halves).

In the illustrative embodiment, each prong is partially folded about its longitudinal midline, thereby forming a "v," at least proximal to the free end thereof. Due to this fold along the longitudinal midline, the side edges (hereinafter "blades") of each prong extend in the radial (as opposed to longitudinal) direction, toward the knurled edge of the spin coupling. The knurling (i.e., a series of successive ridges and channels) facilitates manual tightening of the spin coupling.

The prongs are appropriately distanced from the spin coupling so that contact between the channels of the spin coupling and the blades results in an "outward-" directed force on the free-end of the prongs. That is, the force urges the free-end of the prongs away from the spin coupling. Since the prongs are rigidly attached to the base, this outward force effectively spring loads the cantilevered prongs so that the v-shaped free-end of each prong is biased toward the spin coupling.

Due to the v-shape of the prongs, the two blades on each prong extend in different directions. That is, relative to a line that bisects the "v," one blade extends toward the "left" and the other blade extends toward the "right." The blade that extends to the left will tend to prevent inadvertent rotation of the spin coupling in the counter-clockwise direction and the prong that extends to the right will tend to prevent inadvertent rotation in clockwise direction. Yet, the spin coupling can be manually forced, such that it does not have to be removed to decouple the connector.

In this manner, and unlike most prior-art anti-decoupling devices, the present anti-decoupling device interfaces with the exterior of conventional connectors and with existing features thereof (i.e., the knurled edge of the spin coupling). And by virtue of a "clip-on" or "screw-on" functionality of the base, the anti-decoupling devices disclosed herein are able to retrofit virtually any two-part connector.

The utility of the present anti-decoupling devices for retrofitting existing connectors is manifest. In some further embodiments, the present invention provides an improved connector that includes the present anti-decoupling device. In other words, an aspect of the present invention is a new two-part connector that incorporates, at the time of manufacture, an anti-decoupling device as disclosed herein.

DETAILED DESCRIPTION

Figure 1B:
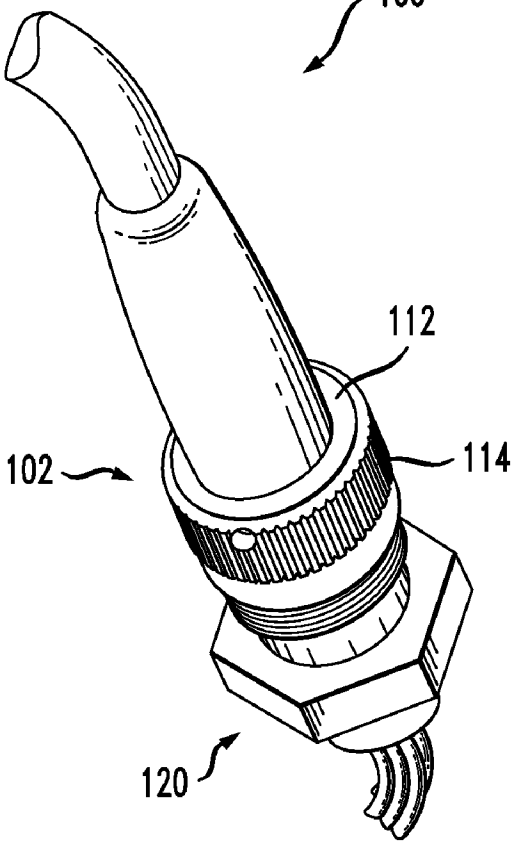
FIG. 1B PRIOR ART
FIG. 1B depicts the conventional, two-part electrical connector of FIG. 1, wherein the two parts of the connector are joined.
Figure 1A:
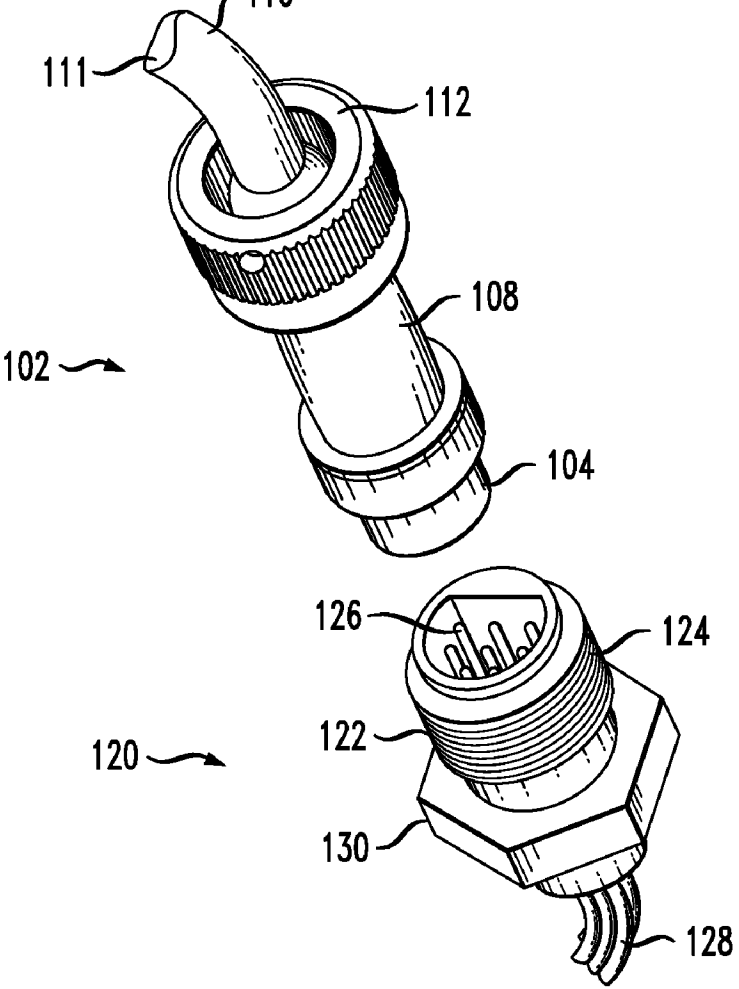
FIG. 1A PRIOR ART
FIG. 1A depicts a conventional, two-part electrical connector having a spin coupling, wherein the electrical connector is in a disconnected state.

FIGS. 1A and 1B depict, via perspective views, the salient elements of a conventional, two-part electrical connector 100. FIG. 1A depicts connector 100 in a disconnected state and FIG. 1B depicts connector 100 in a connected state.

As depicted in FIG. 1A, a female connector portion 102 of connector 100 includes body 104, cable strain relief 108, sheath 110, and spin coupling 112, interrelated as shown. Electrical conductors 111 are disposed in sheath 110 and terminate, at body 104, in sockets (not depicted).

Male connector portion 120 of connector 100 includes body 122, screw threads 124, contact pins 126, electrical conductors 128, and hex mount 130, interrelated as shown. Pins 126 are electrically connected to conductors 128.

To electrically connect electrical conductors 128 to electrical conductors 111, female connector portion 102 and male connector portion 120 are pushed together into mating engagement. In this state, pins 126 are received by the sockets within body 104 of female connector portion 102. It will be understood that the association of some of the features with one or the other of the "female" connector or the "male" connector is somewhat arbitrary and interchangeable.

It is imperative that, once connected, male connector portion 120 and female connector portion 102 do not disengage or otherwise loosen to the point that the integrity of the electrical coupling between the two sets of conductors is threatened. To that end, spin coupling 112, which is internally threaded, is "screwed" onto threads 124 of male connector portion 120. Spin coupling 112 includes knurled edge 114. The "knurls" comprise alternating "ridges" and "channels" that facilitate manually tightening spin coupling 112. The mated connector appears in FIG. 1B.

Experience has shown that vibration, shock, G-forces, and other physical disturbances are capable of loosening spin coupling 112. Consequently, it is advisable to provide two-part connectors that incorporate a spin coupling with an anti-decoupling device.

Figure 2B:
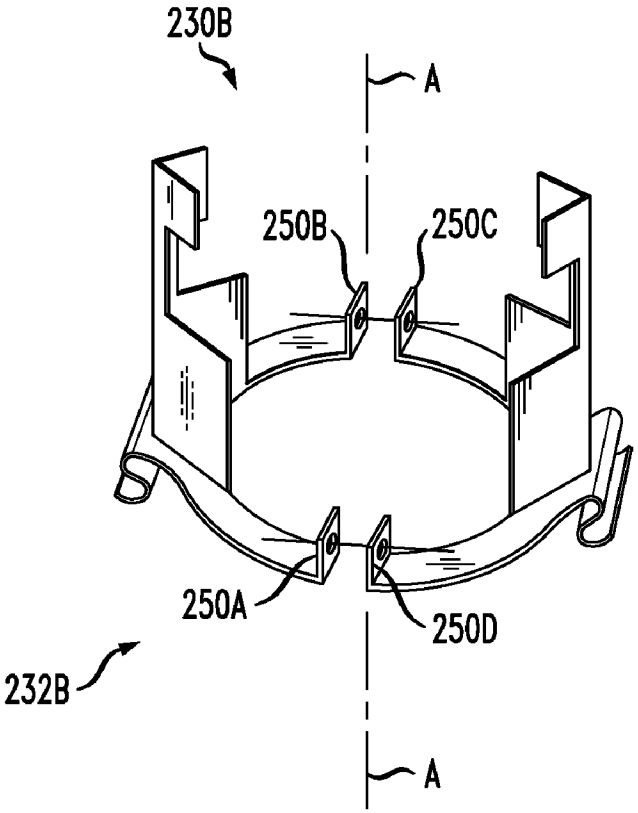
FIG. 2B depicts an alternative embodiment of an anti-decoupling device, wherein the anti-decoupling device comprises two, separable parts.
Figure 2A:
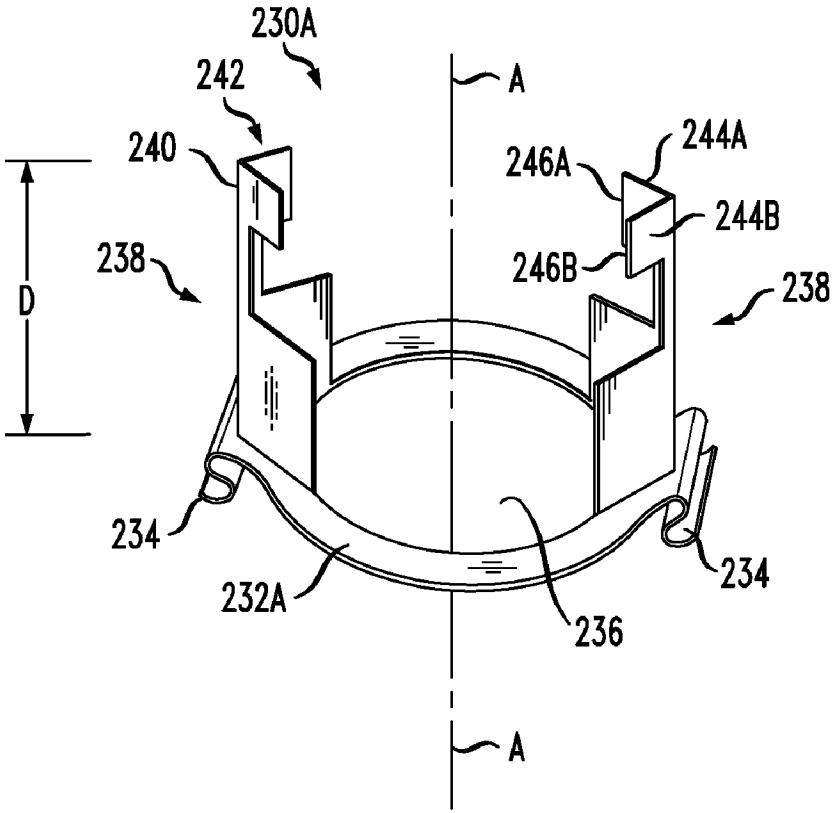
FIG. 2A depicts an anti-decoupling device in accordance with the illustrative embodiment of the present invention.

FIG. 2A depicts anti-decoupling device 230A in accordance with the illustrative embodiment of the present invention. As depicted in FIG. 2A, anti-decoupling device 230A includes base 232A and prongs 238, interrelated as shown. Base 232A and prongs 238 may suitably be formed of metal, plastic, or the like.

Base 232A includes a physical adaptation that enables it to couple to a connector. In the illustrative embodiment, this physical adaptation is clip 234. The clip enables anti-decoupling device 230A to couple to any feature that has substantially flat sides, such as a hex nut, a square or rectangular flange, etc. In the illustrative embodiment, base 232A includes two clips 234 that are diametrically opposed to one another about base 232A.

Base 232A also incorporates large central opening 236. This opening accommodates the body of the connector (half) to which anti-decoupling device 230A will be attached (see, e.g., FIG. 3).

As depicted in FIG. 2A, prongs 238 extend substantially parallel to central axis A-A, which, for reference herein, is described as extending in the "axial" direction or, in some cases, as a "longitudinal" direction. In some embodiments, prongs 238 deviate slightly "inward" of parallel (i.e., slightly toward axis A-A) for reasons that will become clear later in this specification.

In the illustrative embodiment, prongs 238 are diametrically opposed to one another on base 232A. Each prong 238 extends a distance, D, in the axial direction that will position its free end 242 in alignment with the spin coupling of a joined and locked two-part part connector. This distance will vary for different connectors; as a consequence, distance D will be different for various versions of the present anti-decoupling device.

In the illustrative embodiment, each prong 238 is partially folded about its longitudinal midline 240, thereby bending the prong into the shape of a "v." This fold creates blades 244A and 244B, which, due to the fold, extend in a lateral or radial direction toward the central axis A-A.

FIG. 2B depicts anti-decoupling device 230B, which is a two-piece although otherwise identical version of anti-decoupling device 230A. As depicted in FIG. 2B, base 232B comprises two semi-circular portions that are attached (e.g., via screws, bolts, etc.) to one another at flanges 250A/250D and 250B/250C. The two piece construction enables anti-decoupling device 230B to be coupled to an in-field connector without having to separate the connector.

Figure 3:
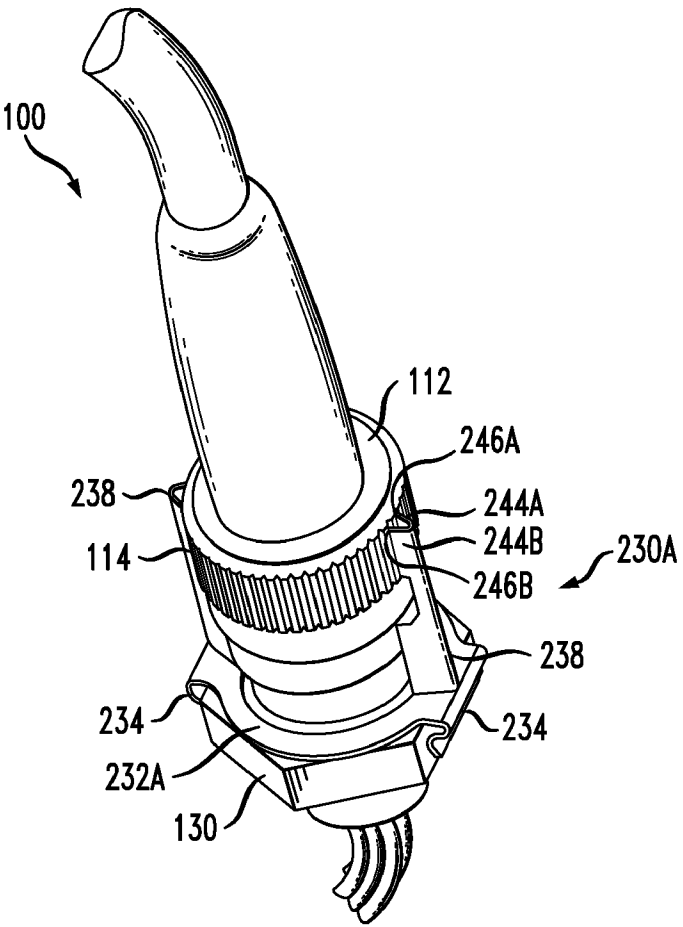
FIG. 3 depicts the anti-decoupling device of FIG. 2A used in conjunction with the two-part connector of FIGS. 1A and 1B to prevent inadvertent rotation of the spin coupling.

FIG. 3 depicts anti-decoupling device 230A engaged to two-part electrical connector 100. Alternatively, FIG. 3 depicts a new two-part electrical connector that includes anti-decoupling device 230A.

In either case, clips 234 are spread to engage hex mount 130, thereby securely coupling anti-decoupling device 230A to connector 100. Blades 244A and 244B of each prong 238 extends into the channels of knurled edge 114 of spin coupling 112.

Prongs 238 are appropriately distanced from spin coupling 112 so that contact between the channels of the spin coupling and edges 246A and 246B of blades 244A and 244B forces the free-end of the prongs outward (i.e., away from the spin coupling). Since prongs 238 are rigidly attached at their other end to base 232A, this outward force effectively spring loads the cantilevered prongs 238. As a consequence, when in contact with the channels, blades 244A and 244B are biased toward the spin coupling.

Figure 4:
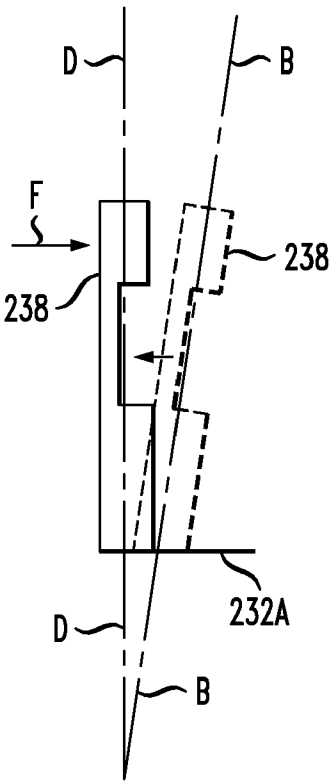
FIG. 4 depicts a representation of the manner in which a "spring" bias is developed in the prongs of the anti-decoupling device.

This effect is illustrated in FIG. 4, which depicts, in phantom, the quiescent or unstressed state of prong 238 (wherein the prong aligns with axis B-B) and a biased state of prong 238 (wherein the prong aligns with axis D-D). As depicted in FIG. 4, in the biased state, the free end of prong 238 is forced "outward." Since the prong is attached to base 232A at its other end, this outward forcing of the free end results in a "spring bias" that is directed toward spring coupling 112. Note that in FIG. 4, prong 238 exhibits a slight inward deviation in its unstressed or quiescent state (as aligned with axis B-B), as described above.

Figure 5:
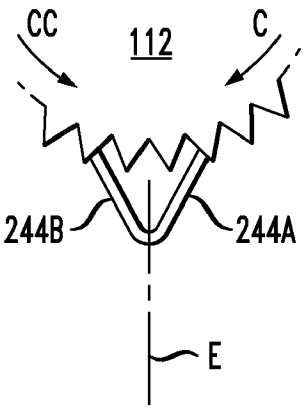
FIG. 5 depicts a close up of the interaction between a spin coupling and the anti-decoupling device of FIG. 2A or 2B.

As depicted in FIG. 5, due to the v-shape of the prongs, blades 244A and 244B on each prong extend in different directions. That is, relative to line E that bisects the "v," blade 244B extends toward the "left" and blade 244A extends toward the "right." Blade 244B, which extends to the left, will tend to prevent inadvertent rotation of spin coupling 112 in counter-clockwise direction CC. Blade 244A, which extends to the right, will tend to prevent inadvertent rotation of spin coupling 112 in clockwise direction C. (Of course, movement in only one of the directions—counterclockwise or clockwise—would loosen the coupling.) Yet, the spin coupling can be manually forced, such that it does not have to be removed to decouple the connector.

Figure 6A:
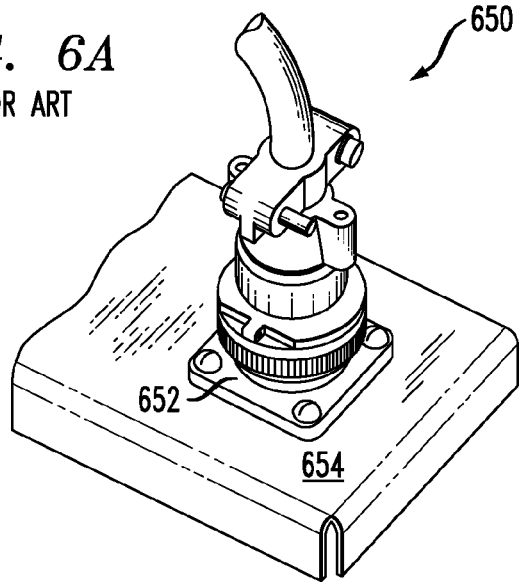
FIG. 6A PRIOR ART
FIG. 6A depicts a conventional mil type circular connector.
Figure 6B:
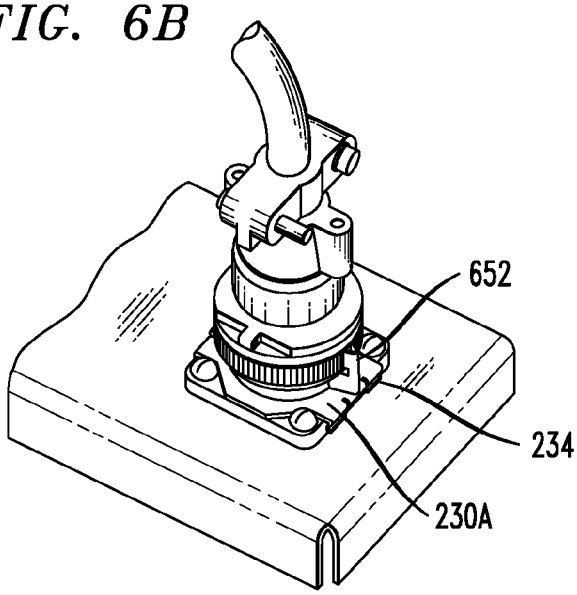
FIG. 6B depicts an embodiment of an anti-decoupling device for use in conjunction with the connector of FIG. 6A, wherein the anti-decoupling device is adapted to clip on to a flange that attaches the connector to a bulkhead.
Figure 6C:
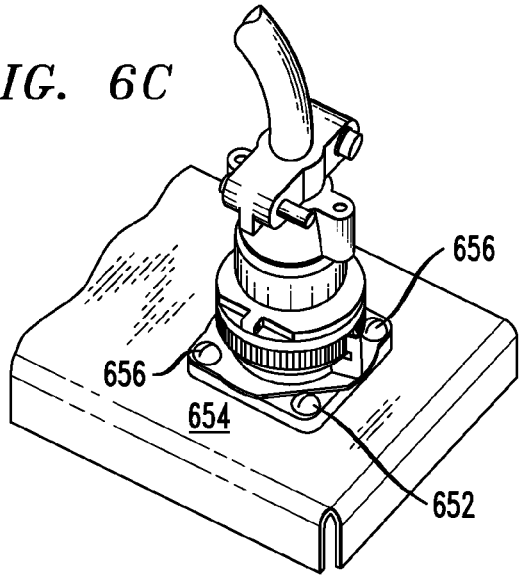
FIG. 6C depicts an embodiment of an anti-decoupling device for use in conjunction with the connector of FIG. 6A, wherein the anti-decoupling device is adapted for screw mounting to the flange that attaches the connector to the bulkhead.

FIG. 6A depicts conventional mil type circular connector 650. In the illustration shown in FIG. 6A, the connector is attached, via flange 652, to bulkhead 654. FIG. 6B depicts anti-decoupling device 230A coupled to flange 652 via clips 234. FIG. 6C depicts an embodiment of an anti-decoupling device wherein the physical adaptation of the base that enables it to couple to the connector are small holes 656 that accept the screws/bolts that attach flange 652 to bulkhead 654.

It is to be understood that the disclosure teaches just one example of the illustrative embodiment and that many variations of the invention can easily be devised by those skilled in the art after reading this disclosure and that the scope of the present invention is to be determined by the following claims.

For example, it is to be understood that prongs 238 need not be "folded" as depicted in the illustrative embodiment. Rather, in some embodiments, two blades are attached (e.g., soldered, glued, etc.) to longitudinal members to form a "prong."

In fact, the presence of a structure on anti-decoupling device 230A that is appropriately described as a "prong" is not necessary per se. What is important is to provide the functionality that is provided by the prongs of the illustrative embodiment.

Namely, to provide a means that engages the knurled edge of the spin coupling in such a way as to prevent the spin coupling from moving.

What is claimed is:

1. An article comprising an anti-decoupling device for use with a two-part connector having a spin coupling, wherein the spin coupling joins the two parts of the connector, the anti-decoupling device comprising:

a flat base, wherein the base includes an opening for receiving a portion of the connector and further includes a physical adaptation for immobilizing the base relative to the connector; and a first prong having a first end and a second end, wherein:

(a) the first end of the first prong depends from the base;

(b) the first prong extends in an axial direction, relative to the base, by an amount that is sufficient to position the second end of the first prong in opposed relation to the spin coupling when the spin coupling is in a locking position;

(c) a first blade and a second blade extend toward the spin coupling from the second end of the first prong, wherein the first blade and the second blade are dimensioned to extend into channels on a knurled side of the spin coupling; and (d) the prong is dimensioned and arranged, relative to the spin coupling, so that when the first blade and the second blade are received by the channels, a force results that biases the first blade and the second blade toward the spin coupling.

2. The article of claim 1 wherein the first blade is oriented in a first direction for opposing counter-clockwise movement of the spin coupling and the second blade is oriented in a second direction for opposing clockwise movement of the spin coupling.

3. The article of claim 1 further comprising a second prong, wherein the second prong is diametrically opposed to the first prong on the base, and wherein the second prong extends in the same direction and for about the same distance as the first prong.

4. The article of claim 1 wherein the base comprises two detachable parts.

5. The article of claim 1 wherein the first prong is partially folded about a longitudinal midline thereof.

6. The article of claim 1 wherein the physical adaptation comprises a gripping element.

7. The article of claim 1 wherein the physical adaptation comprises two opening in a marginal region of the base, wherein the openings receive a fastening means.

8. The article of claim 1 wherein the two-part connector comprises a first part and a second part, wherein the base is received by the first part and the spin coupling is permanently coupled to the second part.

9. An article comprising an anti-decoupling device for use with coupled first and second connector halves, wherein the connector halves are locked together by a spin coupling, the anti-decoupling device comprising:

a base, wherein the base is coupled to the first connector half and further wherein the base includes a physical adaptation for immobilizing the base relative to the first connector half; and a first blade, wherein the first blade is longitudinally spaced-apart from the base so that the first blade aligns with the spin coupling, further wherein the first blade extends in a substantially radial direction and is appropriately dimensioned to extend into channels formed in knurling on the spin coupling.

10. The article of claim 9 wherein the base comprises a flat ring, wherein a centrally-disposed opening of the ring is suitably size for receiving the first connector half.

11. The article of claim 9 wherein the base comprises two detachable portions, wherein the two detachable portions are dimensioned and arranged to permit the anti-decoupling device to be coupled to the two connector halves after the connector halves are coupled to one another via the spin coupling.

12. The article of claim 9 wherein the anti-decoupling device further comprising a second blade, wherein the second blade is longitudinally spaced-apart from the base the same distance as the first blade, and further wherein the second blade extends in a substantially radial direction and is appropriately dimensioned to extend into the channels formed in the knurling on the spin coupling.

13. The article of claim 12 wherein the first blade and the second blade are spaced-apart from the base by a first prong, wherein the first prong has a first end and a second end, and further wherein the first prong depends, at the first end thereof, from the base, and wherein the first blade and the second blade depend from the second end of the first prong.

14. The article of claim 12 further comprising a third blade and a fourth blade, wherein the third blade and the fourth blade are:

(i) diametrically-opposed to the first and second blades about the spin coupling; and (ii) longitudinally spaced-apart from the base by the same amount as the first and second blades.

15. The article of claim 12 wherein the first and second blades collectively define a v-shape.

16. The article of claim 9 wherein the first blade is spaced-apart from the base by a first prong, wherein the first prong has a first end and a second end, and further wherein the first prong depends, at the first end thereof, from the base, and wherein the first blade depends from the second end of the first prong.

17. The article of claim 16 wherein the second end of the prong is disposed radially-inward of the first end of the prong, so that when the first blade contacts the spin coupling, a force results that biases the first blade toward the spin coupling.

18. An article comprising an anti-decoupling device for use with coupled first and second connector halves, wherein the connector halves are locked together by a spin coupling, the anti-decoupling device comprising:

a base, wherein the base is coupled to the first connector half and further wherein the base includes a physical adaptation for immobilizing the base relative to the first connector half; and a first cantilevered prong that depends from the base and extends along the first connector half in substantially parallel relation thereto, wherein a free end of the first prong is biased to engage the spin coupling in a manner that prevents rotation thereof.

19. The article of claim 18 wherein the first cantilevered prong is partially folded along its longitudinal midline, thereby forming a v-shape, wherein, due to the fold, side edges of the first prong extend toward the spin coupling and into channels formed on the exterior thereof.

20. The article of claim 18 wherein the anti-decoupling device comprises a second cantilevered prong that depends from the base at a location that is diametrically opposed to the first cantilevered prong, and wherein the second cantilevered prong extends along the first connector half in substantially parallel relation thereto, and further wherein a free end of the second prong is biased to engage the spin coupling in a manner that prevents rotation thereof.

* * * * *